US007899343B2

(12) United States Patent
Fujioka

(10) Patent No.: US 7,899,343 B2
(45) Date of Patent: Mar. 1, 2011

(54) IMAGE FORMING APPARATUS

(75) Inventor: Ryota Fujioka, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 149 days.

(21) Appl. No.: 12/019,156

(22) Filed: Jan. 24, 2008

(65) Prior Publication Data

US 2008/0181638 A1 Jul. 31, 2008

(30) Foreign Application Priority Data

Jan. 31, 2007 (JP) ..... 2007-022309

(51) Int. Cl.
*G03G 15/00* (2006.01)
*G03G 15/08* (2006.01)
*G03G 15/10* (2006.01)

(52) U.S. Cl. ..... 399/27; 399/12; 399/58

(58) Field of Classification Search ..... 399/27, 399/58, 12
See application file for complete search history.

(56) References Cited

U.S. PATENT DOCUMENTS

| | | | | |
|---|---|---|---|---|
| 6,055,388 | A * | 4/2000 | Watanabe et al. | 399/58 |
| 6,301,449 | B1 * | 10/2001 | Miura | 399/12 |
| 6,510,293 | B1 * | 1/2003 | Nozawa | 399/43 |
| 6,546,212 | B1 * | 4/2003 | Ogata et al. | 399/24 |
| 6,553,191 | B1 * | 4/2003 | Nakane | 399/38 |
| 6,859,634 | B2 * | 2/2005 | Itoh et al. | 399/258 |
| 6,871,026 | B2 * | 3/2005 | Shimura et al. | 399/12 |
| 7,050,729 | B2 * | 5/2006 | Fujiwara | 399/27 |
| 7,280,773 | B2 * | 10/2007 | Uno | 399/27 |
| 7,395,002 | B2 * | 7/2008 | Funayama et al. | 399/49 |
| 2001/0055497 | A1 * | 12/2001 | Hasegawa et al. | 399/58 |
| 2002/0021909 | A1 * | 2/2002 | Harumoto | 399/27 |
| 2004/0141765 | A1 * | 7/2004 | Shimura et al. | 399/49 |
| 2005/0191067 | A1 * | 9/2005 | Uno | 399/27 |
| 2007/0058996 | A1 * | 3/2007 | Sakita et al. | 399/27 |
| 2008/0145078 | A1 * | 6/2008 | Tomita et al. | 399/60 |

FOREIGN PATENT DOCUMENTS

| | | | |
|---|---|---|---|
| JP | 2001125365 | A * | 5/2001 |
| JP | 2004078062 | A * | 3/2004 |
| JP | 2005-178058 | A | 7/2005 |
| JP | 2006-251384 | A | 9/2006 |

* cited by examiner

*Primary Examiner*—David M Gray
*Assistant Examiner*—Francis Gray
(74) *Attorney, Agent, or Firm*—Fitzpatrick, Cella, Harper & Scinto

(57) ABSTRACT

An image forming apparatus includes an image bearing member on which an electrostatic image is to be formed; a developing device for accommodating a developer including toner and a carrier and for developing the electrostatic image with the developer; a developer supply container, detachably mountable to a main assembly of the image forming apparatus, for accommodating a supply developer including the toner; a detecting device for detecting a toner content of the developer in the developing device; a supply control device for controlling an operation of supplying the supply developer into the developing device on the basis of a detection result of the detecting device and a density target value; a memory element, provided on the developer supply container, for storing information relating to elapse time from a manufacturing date of the supply developer; and a controller for determining the density target value in accordance with the information, wherein the supply control device controls the supply operation on the basis of the detection result of the detecting device and the density target value determined by the controller.

6 Claims, 10 Drawing Sheets

IMAGE FORMING APPARATUS

FIELD OF THE INVENTION AND RELATED ART

The present invention relates to an image forming apparatus which forms an image with the use of an electrophotographic method.

In recent years, a cartridge, such as a toner cartridge, has come to be used as a means for supplying an electrophotographic image forming apparatus, for example, an electrophotographic printer, an electrophotographic copying machine, etc., with developer (toner). In order to ensure that an electrophotographic image forming apparatus remains above a preset satisfactory level in terms of image quality, it is desired that the image forming apparatus is changeable in settings in response to the state of the toner in a toner cartridge, which continuously changes with an elapse of time.

The following technology is disclosed in Japanese Laid-open Patent Application 2005-178058. That is, the production date of a process cartridge, the date at which the process cartridge was mounted in an image forming apparatus, and the coefficient of toner deterioration, are stored in a memory attached to the process cartridge. Then, the above-mentioned information in the memory of the process cartridge is used along with the degree of the toner deterioration which occurred while the process cartridge remained in its packaging, a degree of the toner deterioration which occurred while the process cartridge was left inactive after the mounting of the process cartridge into the main assembly of an image forming apparatus, and a degree of the toner deterioration which is attributable to the actual usage of the process cartridge, in order to calculate (estimate) the point in time, beyond which the toner in the process cartridge will not be satisfactory in quality. Then, the results of this calculation are displayed on the monitor of the image forming apparatus, or the monitor of an external apparatus to inform a user, an administrator of office equipment, and a maintenance person, of the results.

Japanese Laid-open Patent Application 2006-251384 discloses a technology, which deals with the following problem. That is, the amount of electrical charge which toner is capable of obtaining gradually reduces with the elapse of time. Thus, in a case where a process cartridge, which has been kept in storage for a substantial length of time, is used by an image forming apparatus for the first time, or a process cartridge, which is left unattended (unused) in an image forming apparatus longer than a certain length of time, the image forming apparatus forms images which are excessively high in density, during the initial period of the next image forming operation. Thus, the image forming apparatus outputs copies which have soiled backgrounds, and/or the images are offset. On the other hand, if the length of time a process cartridge is left unused in an image forming apparatus is shorter than a certain length of time, the toner therein remains excessively high in the amount of electrical charge, and therefore, the image forming apparatus fails to output images which are proper in density, during the initial period of the next image forming operation. Thus, according to Japanese Laid-open Patent Application 2006-251384, if it is determined that the length of time a process cartridge is left unused is outside a preset length of time, the development bias, and the potential level to which toner is to be charged, are adjusted to obtain images with a preset level of density.

According to Patent Japanese Laid-open Patent Application 2005-178058 discussed above, a process cartridge is provided with an expiration date, that is, the date beyond which the quality of the developer in the process cartridge cannot be guaranteed. Therefore, whenever a given process cartridge is used for image formation, a user can know how many days the toner in a given process cartridge will remain satisfactory in terms of image quality.

In the case of Patent Japanese Laid-open Patent Application 2005-178058, however, a user is simply informed of the remaining length of time the quality of toner in a process cartridge will remain satisfactory. That is, no measure is offered for extending the length of time the toner in a given process cartridge can be used for forming a satisfactory image. In other words, no measure is offered for forming a normal image with the use of a process cartridge, the guarantee of which has expired.

In the case of Patent Japanese Laid-open Patent Application 2006-251384, if it is known that the toner which is going to be used for image formation has been left unused for a significant length of time, and therefore, has a significantly reduced in the amount of the charge it is capable of obtaining, an image forming apparatus is adjusted in development voltage and charge voltage so that the image forming apparatus outputs an image which is proper in density.

However, recent studies revealed that toner which has been left unused for a substantial length of time is smaller in the amount of charge it obtains, and therefore, is more difficult to electrostatically confine. If toner is difficult to electrostatically confine, it is likely to adhere to the numerous points of the peripheral surface of a photosensitive drum, to which toner is not to adhere, causing such problems that an image forming apparatus yields an image which suffers from a so-called fog, and/or that toner scatters in the internal space of an image forming apparatus, which sometimes results in the formation of an image which suffers from unwanted large toner spots which result as the toner particles having scattered in the main assembly of an image forming apparatus settle while agglomerating.

In summary, above-described measures can make an image forming apparatus yield an image which is proper in density, even if the image forming apparatus uses the toner (process cartridge) which has been left unused for a substantial length of time. However, they cannot increase the amount of electrical charge which the toner can obtain, being therefore problematic in that they cannot prevent the formation of an unsatisfactory image, for example, a foggy image, an image smeared by scattered toner particles, etc.

Therefore, in order to enable an image forming apparatus to yield a normal image when the image forming apparatus is supplied with toner which is several years old, not only must the image forming apparatus be controlled differently from when it is supplied with toner which is substantially smaller in the amount of the deterioration attributable to the elapse of time, but also, a measure must be taken to increase the amount of electrical charge which the toner can obtain.

SUMMARY OF THE INVENTION

Thus, the primary object of the present invention is to provide an image forming apparatus capable of reliably forming a satisfactory image, regardless of the length of time having elapsed since the production of the developer which is being used for image formation.

According to an aspect of the present invention, there is provided an image forming apparatus comprising an image bearing member on which an electrostatic image is to be formed; a developing device for accommodating a developer including toner and a carrier and for developing the electrostatic image with the developer; a developer supply container, detachably mountable to a main assembly of the image forming apparatus, for accommodating a supply developer including the toner; a detecting device for detecting a toner content of the developer in said developing device; a supply control device for controlling an operation of supplying the supply developer into said developing device on the basis of a detection result of said detecting device and a density target value; a memory element, provided on said developer supply container, for storing information relating to elapse time from a manufacturing date of the supply developer; and a controller for determining the density target value in accordance with the information, wherein said supply control device controls the supply operation on the basis of the detection result of said detecting device and the density target value determined by said controller.

According to another aspect of the present invention, there is provided an image forming apparatus comprising an image bearing member on which an electrostatic image is to be formed; a developing device for accommodating a developer including toner and a carrier and for developing the electrostatic image with the developer; a developer supply container, detachably mountable to a main assembly of the image forming apparatus, for accommodating a supply developer including the toner; a toner content detecting device for detecting a toner content of the developer in said developing device; an image density detecting device for detecting a density of a reference toner image formed; a controller for determining a density target value on the basis of the detection result of said image density detecting device, within a predetermined range between upper and lower limit values; a supply control device for controlling an operation of supplying the supply developer into said developing device on the basis of the detection result of said toner content detecting device and the density target value; and a memory element, provided on said developer supply container, for storing information relating to elapse time from a manufacturing date of the supply developer; wherein said controller determines the upper and lower limit values in accordance with information relating to the elapse time, and wherein said supply control device controls the supply operation on the basis of the detection result of said toner content detecting device and the density target value determined by said controller.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter image forming apparatuses in accordance with the present invention will be described in detail with reference to the appended drawings.

Embodiment 1

Figure 1:
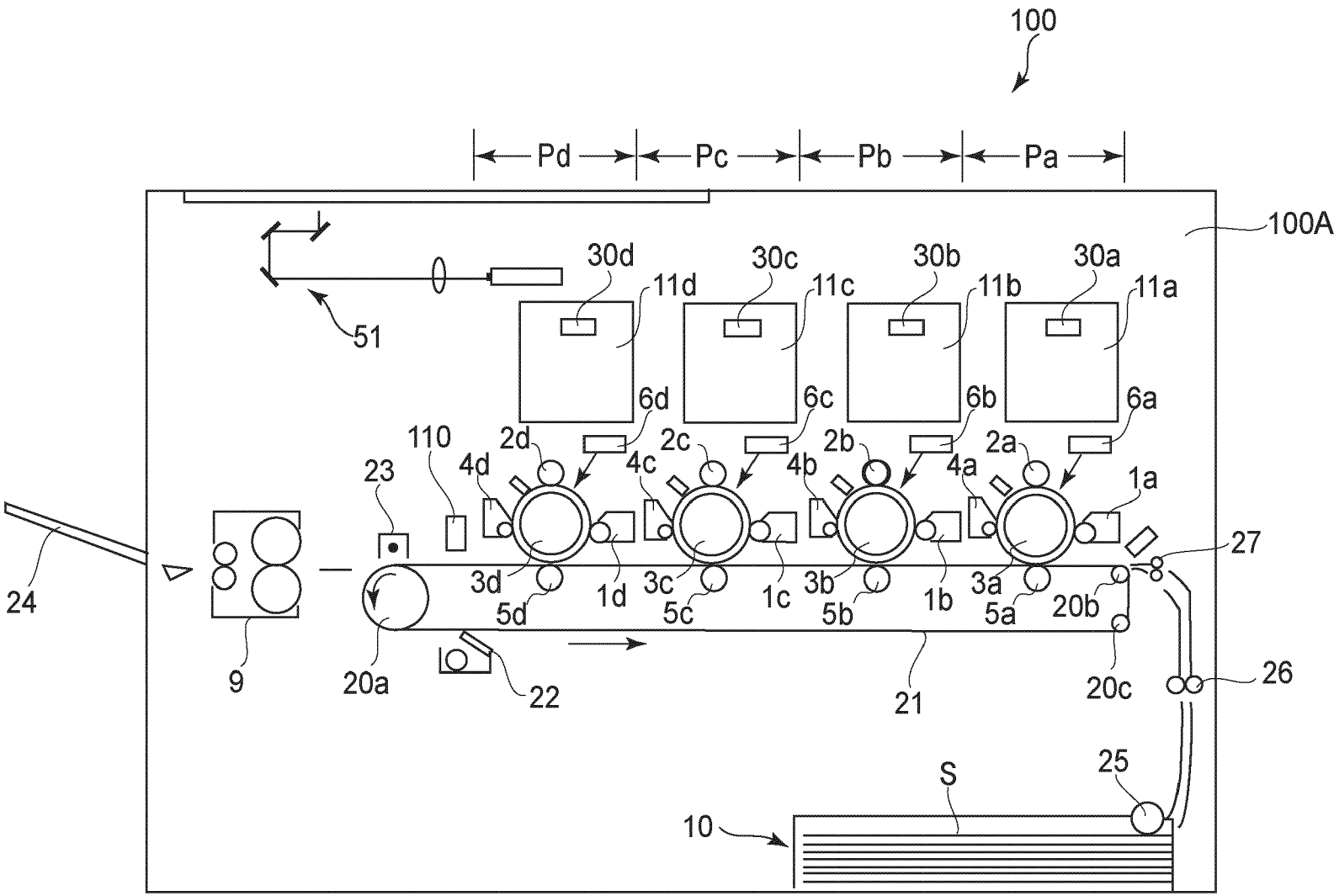
FIG. 1 is a schematic sectional view of the image forming apparatus according to a first embodiment of the present invention, showing the general structure of the apparatus.

FIG. 1 is a schematic, sectional view of the image forming apparatus according to a first embodiment of the present invention, and shows the general structure of the apparatus. The image forming apparatus in this embodiment is a color image forming apparatus of the so-called tandem type. It is also of the direct transfer type. However, this embodiment is not intended to limit the present invention in terms of the type of an image forming apparatus to which the present invention is applicable. That is, the present invention is applicable to various image forming apparatuses structured differently from the image forming apparatus in this embodiment.

In this embodiment, the image forming apparatus 100 has a transfer medium holding member 21 (which hereafter will be referred to as transfer belt), which is in the form of an endless belt. The transfer belt 21 is in the main assembly 100A of the image forming apparatus 100, and is stretched around, and supported by, multiple rollers 20, that is, a driver roller 20*a*, and a pair of follower rollers 20*b* and 20*c*. The transfer belt 21 is rotatably movable in the direction indicated by an arrow mark in the drawing. As the transfer belt 21 is rotated in the direction of the arrow mark, it conveys a sheet of transfer medium S (which hereafter will be simply referred to as transfer medium S) on the transfer belt 21.

The image forming apparatus 100 has first, second, third, and fourth image forming portions P (Pa, Pb, Pc, and Pd), which are juxtaposed in parallel along the transfer belt 21 to form yellow, magenta, cyan, and black toner images, respectively, through a process for forming a latent image, a process for developing the latent image, and a process for transferring the developed image.

The image forming portions Pa, Pb, Pc, and Pd have electrophotographic photosensitive members 3 (3*a*, 3*b*, 3*c*, and 3*d*, respectively) (which hereafter will be referred to as a photosensitive drum), which are in the form of a drum, and on which four toner images, different in color, are formed, one-for-one.

The afore-mentioned transfer belt 21 is positioned so that the juxtaposed photosensitive drums 3*a*, 3*b*, 3*c*, and 3*d* are next to the transfer belt 21. After the toner images, different in color, are formed on the photosensitive drums 3*a*, 3*b*, 3*c*, and 3*d*, one-for-one, they are transferred onto the transfer medium 2 on the transfer belt 21, while the transfer medium 2 is conveyed by the transfer belt 21.

After the transfer of the toner images (which are different in color) onto the transfer medium S, the transfer medium S is separated from the transfer belt 21, and is sent to a fixing portion 9, in which the toner images are fixed by the application of heat and pressure. After the fixation of the toner images, the recording medium S is discharged, as a finished copy, from the image forming apparatus.

In this embodiment, the photosensitive drums 3*a*, 3*b*, 3*c*, and 3*d* are made up of an organic photoconductor, which is negative in the normal polarity to which it is chargeable. It is 30 mm in external diameter, and is rotationally driven about the axial line of a shaft, with which it is rotatably supported, at a process speed (peripheral velocity) of 130 mm/sec in the clockwise direction in FIG. 1.

The image forming apparatus 100 is also provided with charge rollers 2 (2*a*, 2*b*, 2*c*, and 2*d*), as changing means, and laser scanner units 6 (6*a*, 6*b*, 6*c*, and 6*d*), as exposing means. Each charge roller 2 is in contact with the peripheral surface of the corresponding photosensitive drum 3. Each laser scanner unit 6 is in the adjacencies of the peripheral surface of the corresponding photosensitive drum 3. The charge roller 2 and laser scanner unit 6 form an electrostatic image, that is, a latent image, on the corresponding photosensitive drum 3. Further, the image forming apparatus 100 is provided with developing devices 1 (1*a*, 1*b*, 1*c*, and 1*d*), transfer rollers 5 (5*a*, 5*b*, 5*c*, and 5*d*), and cleaning apparatuses 4 (4*a*, 4*b*, 4*c*, and 4*d*), each of which is in the adjacencies of the peripheral surface of the corresponding photosensitive drum 3. The developing device 1 is the developing means for developing an electrostatic latent image on the photosensitive drum 3 into a visible image. The transfer roller 5 makes up the transferring means. The cleaning apparatus 4 is a means for cleaning the corresponding photosensitive drum 3.

Further, the image forming apparatus 100 is provided with toner cartridges 11 (11*a*, 11*b*, 11*c*, and 11*d*), which are the means for supplying the developing devices 1*a*, 1*b*, 1*c*, and 1*d*, respectively, with toner. The toner cartridges 11*a*, 11*b*, 11*c*, and 11*d* are above the photosensitive drums 3*a*, 3*b*, 3*c*, and 3*d*, respectively. The toner cartridges 11*a*, 11*b*, 11*c*, and 11*d* are provided with memory tags 30 (30*a*, 30*b*, 30*c*, and 30*d*) as storage means, which are pasted thereto, one-for-one. Stored in these memory tags 30 is the information regarding the production date of the toner in the toner cartridge 11, and the production date of the developer supply cartridge (toner cartridge) which contains the toner. This information is the information used for obtaining the information regarding the length of the time which elapsed before the developer cartridge was put to use for the first time. Ordinarily, the steps between the toner production and the filling of a toner cartridge with the toner are under strict control. Therefore, the production date of a toner cartridge is usable for obtaining the length of the time which has elapsed since the production date of the toner.

The charge rollers 2*a*, 2*b*, 2*c*, and 2*d* charge the photosensitive drums 3*a*, 3*b*, 3*c*, and 3*d*, respectively, in the charging portions. The voltage applied to charge the photosensitive drums 3 is an oscillatory voltage, that is, a combination of a DC voltage (Vdc) and an AC voltage (Vac). The peripheral surface of each of the photosensitive drums 3*a*, 3*b*, 3*c*, and 3*d* is uniformly charged to 500 V (dark point voltage Vd) by the charge rollers 2*a*, 2*b*, 2*c*, and 2*d*, which are placed in contact with the photosensitive drums 3*a*, 3*b*, 3*c*, and 3*d*, respectively.

Each of the laser scanner units 6*a*, 6*b*, 6*c*, and 6*d* is provided with a light source and a polygon mirror (unshown). A laser light beam emitted by the light source is deflected by the polygon mirror, which is being rotated. Then, it is changed in direction by a deflection mirror, and focused on the peripheral surface of the photosensitive drum 3 by an f-θ lens. As a result, the peripheral surface of the photosensitive drum 3 is scanned by the laser light beam, in the direction parallel with the generatrix of the peripheral surface of the photosensitive drum 3. In other words, the peripheral surface of the photosensitive drum 3 is exposed. Consequently, numerous exposed points of the peripheral surface of the photosensitive drum 3 are changed (reduced) in potential from −500 V to −200 V (light potential level V1), in response to pictorial signals obtained from the information read by a reading apparatus, effecting thereby a latent image on the peripheral surface of the photosensitive drum 3.

The developing devices 1*a*, 1*b*, 1*c*, and 1*d* contain a preset amount of yellow, magenta, cyan, and black developers, respectively, each of which is a two-component developer, that is, a combination of nonmagnetic toner and magnetic carrier mixed in a preset ratio.

In this embodiment, the magnetic carrier is roughly $10^{13}$ ohm·cm in electrical resistance, and roughly 40 μm in particle diameter (volume average particle diameter: 50% median diameter).

The nonmagnetic toner is a mixture of a resin (polyester resin), a coloring agent, a charge controlling agent, etc.; the coloring agent, charge controlling agent, etc., are dispersed in the polyester resin. Then, the combination is hardened, pulverized, and classified, obtaining thereby nonmagnetic toner which is 9 μm in volume average particle diameter. The thus obtained toner is frictionally chargeable to the negative polarity by the magnetic carrier. The amount of electrical charge, which the toner in this embodiment is capable of obtaining, in an ambient environment which is 23° C. in temperature and 10.6 g/m$^3$ in an absolute amount of humidity, immediately after its production, is rough 30 μC/g in absolute value (hereafter, unless noted, "amount of toner charge" is the amount of toner charge immediately after toner production).

The developing devices 1*a*, 1*b*, 1*c*, and 1*d* develop the latent images on the photosensitive drums 3*a*, 3*b*, 3*c*, and 3*d* into visible images, that is, yellow, magenta, cyan, and black toner images, respectively.

The transfer rollers 5*a*, 5*b*, 5*c*, and 5*d* are kept pressed against the photosensitive drums 3*a*, 3*b*, 3*c*, and 3*d*, in the transferring portions of the image forming portions Pa, Pb, Pc, and Pd, respectively, with the application of a preset amount of pressure. Each of the transfer rollers 5*a*, 5*b*, 5*c*, and 5*d* is made up of a metallic core, and an elastic cylindrical layer formed around the metallic core. The examples of the material for the elastic layer are various foams made up of rubber, high polymer elastomer, such as urethane, or the like. They contain an ion conductive substance, such as sodium perchlorate. They are $1\times10^6$ ohm·cm in volume average resistance.

The transfer medium S is conveyed so that it arrives at each of the above-mentioned transferring portions with preset timing. More specifically, the transfer medium S is stored in a transfer medium cassette 10, and is fed therefrom by a sheet feeder roller 25, a pair of sheet conveyance rollers 26, and a pair of registration rollers 27, onto the transfer belt 21. Then, it is conveyed by the transfer belt 21 sequentially through the transferring portions, that is, the areas of contact between the transfer belt 21 and photosensitive drums 3*a*, 3*b*, 3*c*, and 3*d*.

The transfer belt 21 is an endless belt. It is formed by joining the lengthwise ends of a piece of ordinary belt, or it is a seamless endless belt. It is rotated by the driver roller 20*a*. The transfer medium S is conveyed by the registration rollers 27 onto the transfer belt 21, and then, is conveyed to the transferring portion Pa of the first image forming portion Pa.

Meanwhile an image writing start signal is outputted to begin forming an image of the first color (yellow) on the portion of the peripheral surface of the photosensitive drum 3*a*, which is in the first image forming portion Pa, with preset timing. Then, the image formed of the toner of the first color (yellow) is transferred onto the transfer medium S by applying an electric field or electrical charge between the photosensitive drum 3*a* and transfer roller 5*a*. This process of transferring the toner image of the first color onto the transfer medium S ensures that the transfer medium S remains electrostatically adhered to the transfer belt 21. Then, the transfer medium S is conveyed consecutively through the second, third, and fourth transferring portions Pb, Pc, and Pd.

Also in the second, third, and fourth image forming portions Pb-Pd, an image forming operation and an image transferring operation, which are similar to those carried out in the first image forming portion Pa, are carried out.

Thereafter, the transfer medium S, onto which four toner images, different in color, have just been transferred, is subjected to a separation charger 23 (charging device) located on the downstream side of the fourth image forming portion Pd, in terms of the moving direction of the transfer belt 21, in order to remove electrical charge to minimize the electrostatic force which keeps the recording medium S and transfer belt 21 adhered to each other. Thus, the transfer medium S becomes separated from the transfer belt 21 at the downstream end of the loop which the transfer belt 21 forms.

The image forming apparatus is provided with a transfer belt cleaning blade 22 for removing the toner particles (fog generation toner particles, scattered toner particles, etc.), etc., on the transfer belt 21. In terms of the moving direction of the transfer belt 21, the transfer belt cleaning blade 22 is on the downstream side of the area where the transfer medium S separates from the transfer belt 21. The transfer belt cleaning blade 22 is always kept in contact with the transfer belt 21.

After the separation of the transfer medium S from the transfer belt 21, the transfer medium S is conveyed to the fixing portion 9, in which the four toner images, different in color, are fixed to the transfer medium S while being mixed. As a result, a permanent full-color image is effected on the transfer medium S; a full-color copy is produced. Then, the transfer medium S is discharged into a delivery tray 24.

Meanwhile, the photosensitive drums 3*a*, 3*b*, 3*d*, and 3*d* are cleaned by the photosensitive drum cleaning apparatuses 4*a*, 4*b*, 4*c*, and 4*d*, respectively; the toner particles remaining on the photosensitive drums 3*a*, 3*b*, 3*c* and 3*d* are removed by the fur brushes, blades, or the like, of the cleaning apparatuses 4*a*, 4*b*, 4*c*, and 4*d*, respectively. As for the toner particles having adhered to the transfer belt 21, they are removed by the transfer cleaning blades 22, as described above.

Figure 2:
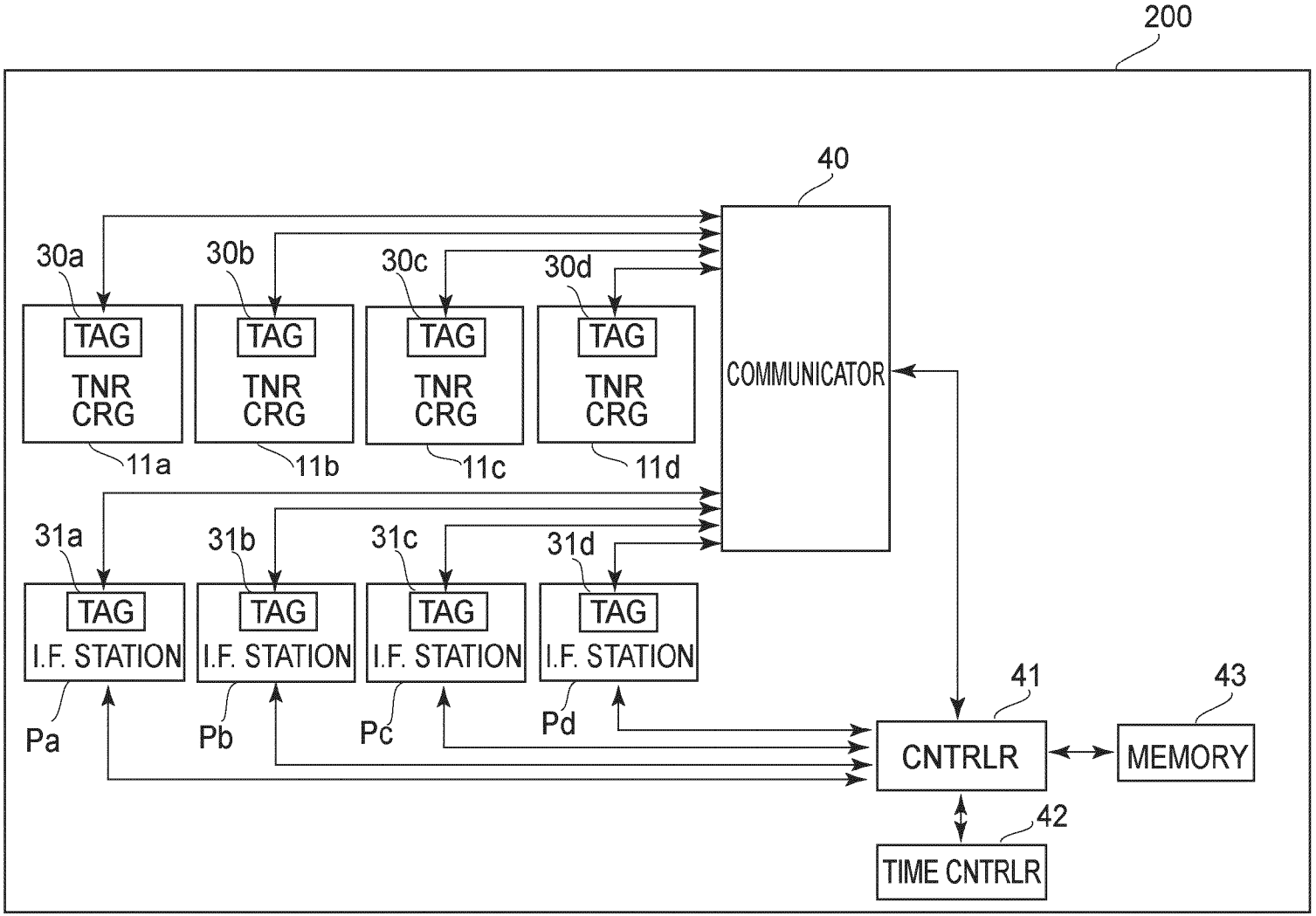
FIG. 2 is a block diagram of the controlling means for controlling the process of supplying the image forming apparatus with developer.

FIG. 2 is a block diagram of the controlling means 200 of the image forming apparatus in this embodiment, which controls the process of supplying the image forming apparatus with developer. It shows the general structure of the controlling means 200.

In this embodiment, the image forming portions P (Pa, Pb, Pc, and Pd) are provided with image forming portion tags 31 (31*a*, 31*b*, 31*c*, and 31*d*), which are pasted on the image forming portions P, more specifically, developing devices 1 (1*a*, 1*b*, 1*c*, and 1*d*) of the image forming portions P, respectively, whereas, the toner cartridges 11 (11*a*, 11*b*, 11*c*, and 11*d*), which are removably mounted in the image forming portions P (Pa, Pb, Pc, and Pd) are provided with toner cartridge tags 30 (30*a*, 30*b*, 30*c*, and 30*d*), which are pasted on the toner cartridges 30, one-for-one.

A communicating portion 40 exchanges information, such as the production date of toner (or production date of a toner cartridge), with the tag of each toner cartridge. A controlling portion 41 (controller) is provided with hardware having computational functions and the software for regulating the computational functions of the hardware. It processes the information from the communicating portion 40, a clock controlling portion 42, and the storage portion 43. It also controls the operations of the image forming portions Pa, Pb, Pc, and Pd. Further, the controlling portion 41 (controller) functions as the means for setting a target value for the density level, according to the information, such as the production date of toner, obtained from the above-mentioned tags 30. This operation of the controlling portion 41 will be described later. The clock controlling portion 42 is provided with a calendar function, and outputs the current date and time. The storage portion 43 is made up of semiconductor memories, hard discs, or the like. It stores various data, such as the tables containing the relationship between the target value for image density, and the ambient conditions. It also stores programs, which are necessary for controlling the transfer voltage.

Figure 3:
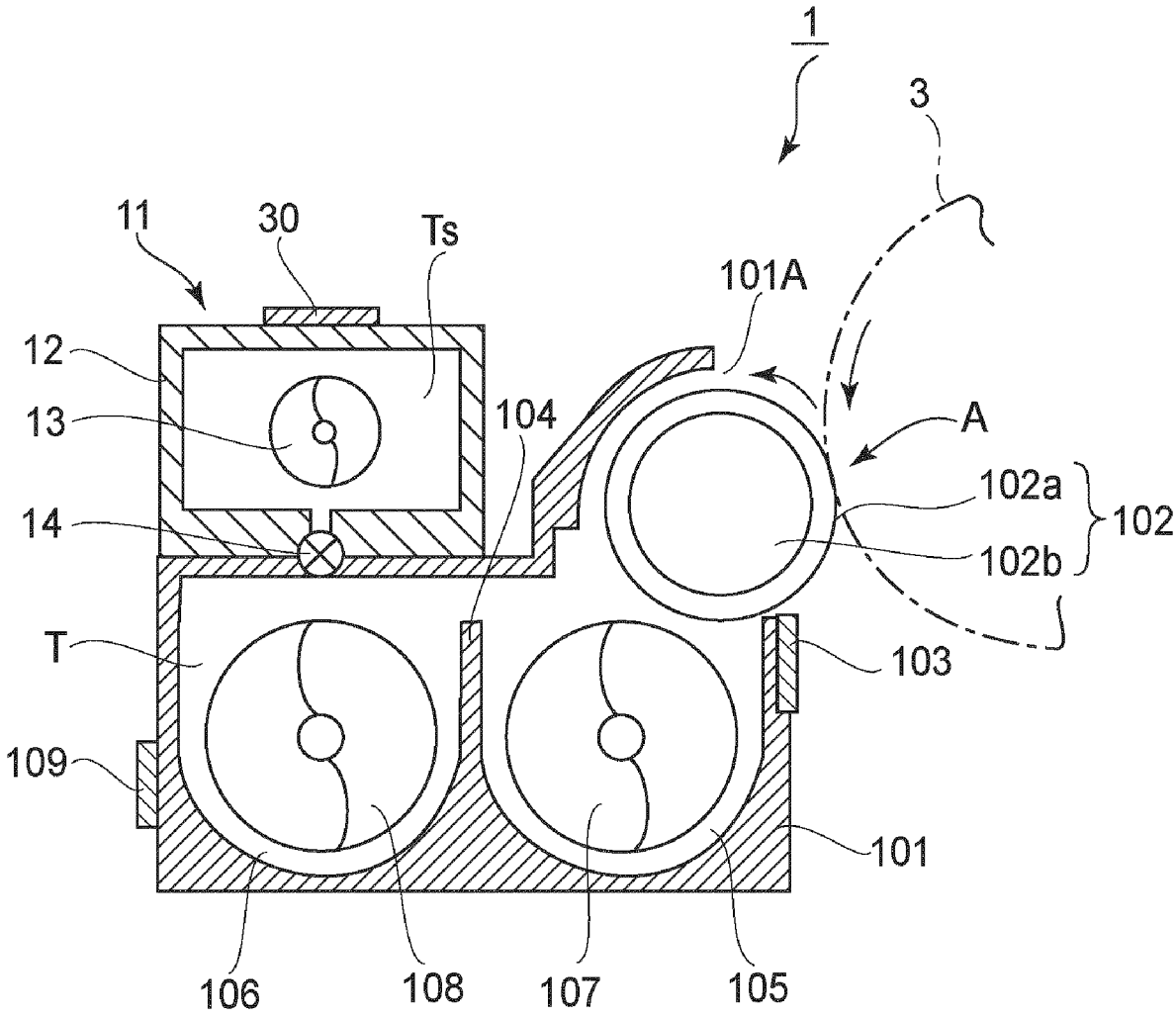
FIG. 3 is a schematic, sectional view of the developing device, according to the first embodiment of the present invention, provided with a developer delivering means, showing the general structure of the device.
Figure 4:
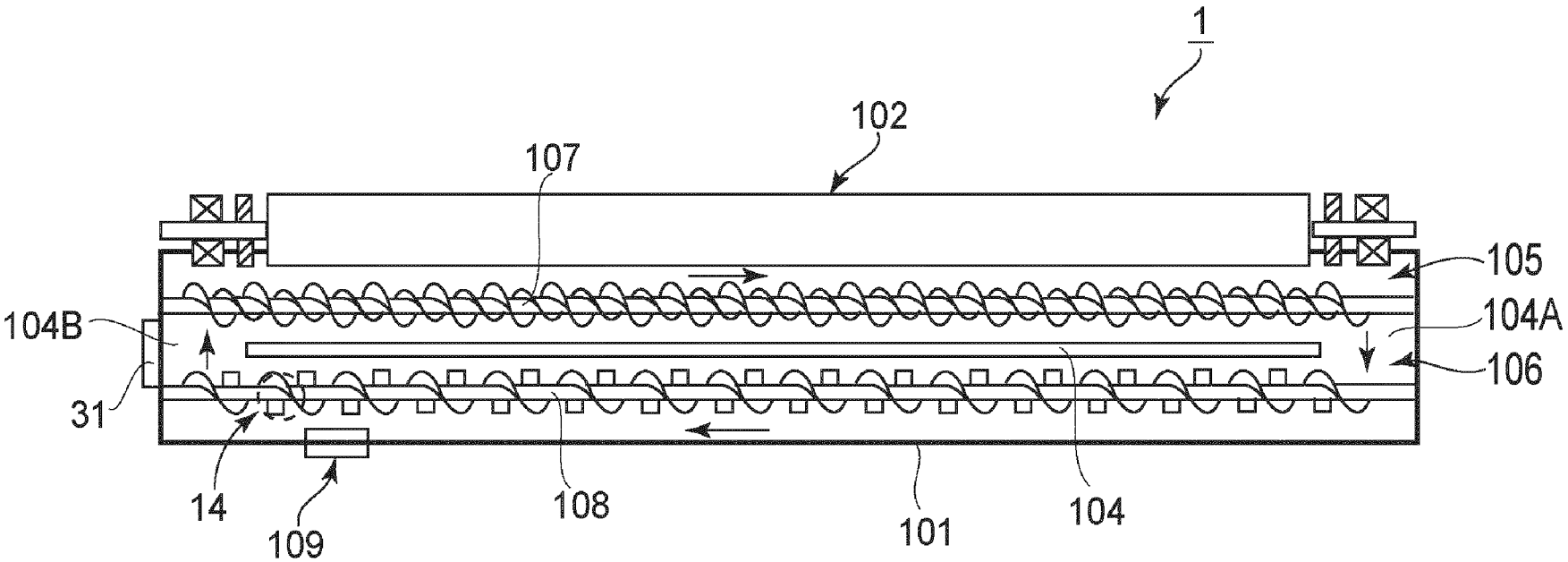
FIG. 4 is a phantom, top view of the developing device shown in FIG. 3, showing the general structure of the device.

Next, the components which make up each of the image forming portions (that is, processing means) will be described regarding its structure. FIG. 3 is a schematic sectional view of the combination of one of the developing devices 1 and a corresponding toner cartridge 11, in the first embodiment of the present invention, at a plane perpendicular to the lengthwise direction of the combination. FIG. 4 is a phantom, top view of the developing device 1. It shows the structure of the developing device 1.

The developing device 1 is provided with a developer container 101 and a developer bearing member 102. The developer container T contains developer T which is a mixture of toner and magnetic carrier. The developer bearing member 102 conveys the developer T to the photosensitive drum 1 by bearing the developer T on its peripheral surface. The developer container 101 is provided with a hole 101A (opening). The developer bearing member 102 is rotatably supported in the developer container 101 so that it is placed in contact with the photosensitive drum 1 through the hole 101A. The amount by which developer T is borne by the developer bearing member 102, per unit area of the peripheral surface of the developer bearing member 102, is regulated by the developer amount regulating blade 103.

The developer container 101 is provided with a developer supply chamber 105 and a developer stirring chamber 106, which are partitioned from each other by a partition wall 104. The developer supply chamber 105 is provided with a developer conveying screw 107, which supplies the developer bearing member 102 with developer. The developer stirring chamber 106 is provided with a developer stirring screws 108, which conveys developer to the developer supply chamber 105 while stirring, and thereby mixing, the developer which has been in the developing device 1, and the freshly supplied toner.

Further, the developing device 1 is provided with a toner density (TD) ratio detecting means 109, which is a means for detecting the toner density of the developer in the developer container 101. The TD ratio detecting means 109 is fitted in a through hole cut through the external wall of the developer stirring chamber 106, extending between the outward and inward sides of the developer stirring chamber 106. It is fitted in the above-mentioned hole, tightly enough to prevent the developer in the developer stirring chamber 106 from leaking. "TD ratio" is the ratio of toner (T) in developer (mixture of toner T and carrier C), that is, the toner density in developer: T/D (D=T+C).

The toner cartridge 11 is a means for supplying (replenishing) the developing device 1 with replenishment developer. It is provided with a replenishment developer container 12, which contains replenishment developer Ts. The replenishment developer container 12 is provided with a conveyer screw 13, which delivers the replenishment developer Ts to the above-mentioned developer stirring chamber 106, through the replenishment developer outlet 14. The replenishment developer Ts may be pure toner, or a mixture of toner and magnetic carrier. Hereafter, the replenishment developer Ts will be referred to simply as "replenishment toner Ts".

As described above, the replenishment developer container 12 has the tag 30, which outputs information, such as the production date of the replenishment toner Ts, to the communication portion 40 of the main assembly of the image forming apparatus.

The developer bearing member 102 has a nonmagnetic development sleeve 102*a*, a stationary magnetic field generating means, that is, a magnetic pole 102*b* (magnet 102), which is in the internal space of the development sleeve 102*a*. In this embodiment, therefore, the developer T is adhered to the peripheral surface of the development sleeve 102*a* by the magnetic field generated by the magnetic field generating means 102*b*, and then, is conveyed in the direction indicated by an arrow mark in the drawing, by the rotation of the development sleeve 102*a*.

After the developer T is borne on the peripheral surface of the developer bearing member, the body of developer T on the peripheral surface of the developer bearing member 102 is regulated by a developer amount regulating blade 103, as the developer bearing member 102 is rotated, so that the amount (per unit area) of the developer on the peripheral surface of the developer bearing member 102 becomes proper. Then, the body of developer T, which is proper in the amount (per unit area), is conveyed, by the further rotation of the developer bearing member 102, to an area A (development area) in which the body of developer T on the peripheral surface of the developer bearing member 102 faces the portion of the peripheral surface of the photosensitive drum 1, which is holding an electrostatic latent image.

As the body of developer T on the developer bearing member 102 arrives at the development area A, the toner in the body of developer T is subjected to the an electrical force generated by the difference in potential level between the electrostatic latent image and development bias. Therefore, the toner (toner particles) jumps toward the photosensitive drum 3 from the developer bearing member 102. The toner particles which have jumped toward the photosensitive drum 3 are reciprocally moved between the developer bearing member 102 and photosensitive drum 3 by the alternating component, that is, the AC voltage of the development bias. While being reciprocally moved as described above, the toner particles having the negative electrical charge are moved by the difference in potential level between the voltage Vdev applied to the developer bearing member 102 and the potential level of the latent image. More specifically, the toner particles, which correspond in position to the numerous points of the peripheral surface of the photosensitive drum 3, the potential level of which is the dark potential level Vd, return to the peripheral surface of the developer bearing member 102, whereas the toner particles, which correspond in position to the numerous points of the peripheral surface of the photosensitive drum 3, the potential level of which is the light potential level V1, adhere (remain adhered) to the peripheral surface of the photosensitive drum 3.

The developer conveying screw 107 is in the developer supply chamber 105. It supplies the developer bearing member 102 with the developer T while sending back a part of the body of developer T on the developer bearing member 102, that is, the portion of the body of developer T, which has been removed by the developer amount regulating blade 103, into the developer stirring chamber 106.

More specifically, referring to FIG. 4, the developer T in the developing device 1 is conveyed in the developer supply chamber 105 by the developer conveying screw 107 in the direction indicated by an arrow mark. As a result, the developer T enters the developer stirring chamber 106 through the hole 104A with which the partitioning wall 104 is provided.

The developer T in the developer stirring chamber 106 is conveyed by the developer stirring screw 108 in the direction, indicated by an arrow mark, which is opposite to the direction in which the developer is conveyed in the developer supply chamber 105. As a result, the developer T circulates back into the developer supply chamber 105 through the hole 104B with which the partitioning wall 104 is provided.

As described above, the developer stirring screw 108 sends the developer T into the developer supply chamber 105 while stirring the developer T which has come back into the developer stirring chamber 106 after being conveyed across the developer supply chamber 105, and the replenishment toner Ts.

As described above, the TD ratio detecting means 109 is in the hole of the developer stirring chamber 106 (in which the developer stirring screw 108 is present), being positioned in a manner to penetrate the wall of the developer stirring chamber 106. It is tightly fitted in the hole so that the developer T does not leak from the developer stirring chamber 106.

Further, in terms of the direction in which the developer T is conveyed by the stirring screw 108, the TD ratio detecting means is on the upstream side of the replenishment developer outlet 14. It detects the TD ratio when the image forming apparatus is started up, when a single copy is made, or the like occasions; the detection of the TD ratio by the TD ratio detecting means is triggered by the starting of a startup operation of the image forming apparatus, the starting of an operation for forming a single image, etc.

In this embodiment, a magnetic permeability sensor, which is capable of detecting the TD ratio by reading the changes in magnetic permeability, is used as the TD ratio detecting means 109. The procedure for supplying the developing device 1 with the replenishment toner Ts based on the TD ratio detected by the TD ratio detecting means 109 will be described later in detail.

As described above, the replenishment developer outlet 14 is located right above the developing device 1 so that after the replenishment toner Ts is sent out of the toner cartridge 11, it lands on the stirring screw 108.

The developer T in this embodiment is two-component developer, which is made up of nonmagnetic toner and magnetic carrier, that is, a mixture of nonmagnetic toner and magnetic carrier. As the nonmagnetic toner is frictionally charged to the negative polarity by the magnetic carrier in the developer supply chamber 105 and developer stirring chamber 106, it is transferred by the coulometric force from the developer bearing member 102 onto the photosensitive drum 1, developing thereby the electrostatic latent image on the photosensitive drum 3.

The ratio in which toner initially is found in the body of developer in the developing device 1, that is, the initial TD ratio, in this embodiment is 8% (wt. %), and the amount of the developer in the developing device 1 is roughly 190 [g].

At this time, the toner deterioration, which is the primary cause of the problem to be dealt with by the present invention, will be described in detail.

Figure 5:
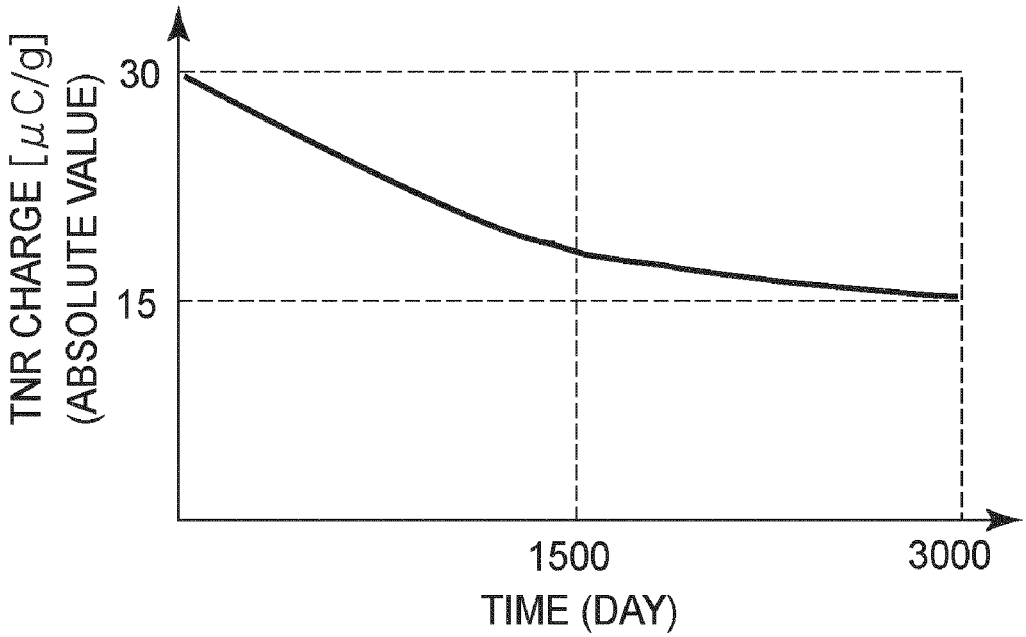
FIG. 5 is a graph showing the relationship between the number of the days having elapsed since the production of toner and amount of toner charge, depicting the toner deterioration which occurs with the elapse of time.

FIG. 5 is a graph showing the relationship between the number of days having elapsed since the production of toner, and the amount of toner charge, depicting the toner deterioration which occurs with the elapse of time. It shows the results of the following experiment: A combination of brand-new toner and carrier, which was 8.0% in TD ratio, was placed in the developing device 1, and was stirred for 60 seconds to frictionally charge the toner, in an ambient environment which was 23° C. in temperature, and 10.6/m$^3$ in absolute humidity. Thus, the toner was frictionally charged by the carrier. The toner (developer) deterioration attributable to the elapse of time was as follows: When the number of elapsed days was virtually zero, the amount of toner charge was roughly 30 [μC/g] in absolute value. In comparison, after the elapse of 3,000 days, the absolute value of the amount of toner charge was roughly 15 [μC/g]. In other words, the elapse of time roughly halved the amount of toner charge. Incidentally, the amount of toner charge was measured with an E-spart Analyzer (product of Hosokawa Micron Co., Ltd.).

The concrete mechanism which is responsible for the reduction in the amount of electrical charge obtainable by toner, which occurs with the elapse of time, is not clear. However, the following seems to be responsible.

They are: the deterioration of the external additive in terms of charging performance, and/or the deterioration of toner in terms of chargeability, which results from the oxidization of the external additives and toner; precipitation of waxy ingredients of a toner particle, which results in the embedding of the external additives in a toner particle; increase in the ratio of carrier relative to toner, which occurs as toner is spent; etc.

Further, the reduction in the amount of electrical charge obtainable by toner reduces the amount of electrostatic force which works between the developer bearing member and the photosensitive drum, in a manner to keep the toner particles confined on the developer bearing member. Therefore, toner adheres to some of the numerous points of the peripheral surface of the photosensitive drum, to which toner is not to adhere, resulting therefore in the formation of the so-called foggy image.

The following has been known by the inventors of the present invention: As the amount of toner charge becomes smaller than roughly 10 [μC/g] in absolute value, the amount by which toner scatters increases, making it more likely for a foggy image to be formed. Therefore, for the prevention of the formation of a foggy image, scattering of toner, and/or stabilization of an image forming apparatus in terms of image density, it is desired that the amount of toner charge can be kept at roughly 20 [μC/g] in absolute value.

Figure 6:
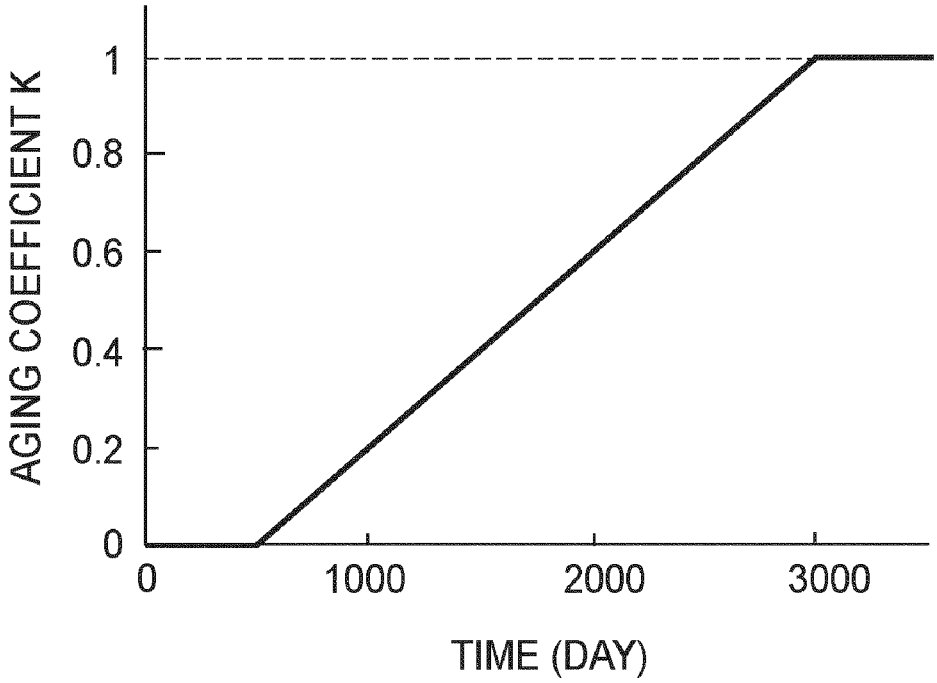
FIG. 6 is a graph showing the relationship between the number of the days having elapsed since the production of the developer, and coefficient k of the elapsed time.
Figure 7:
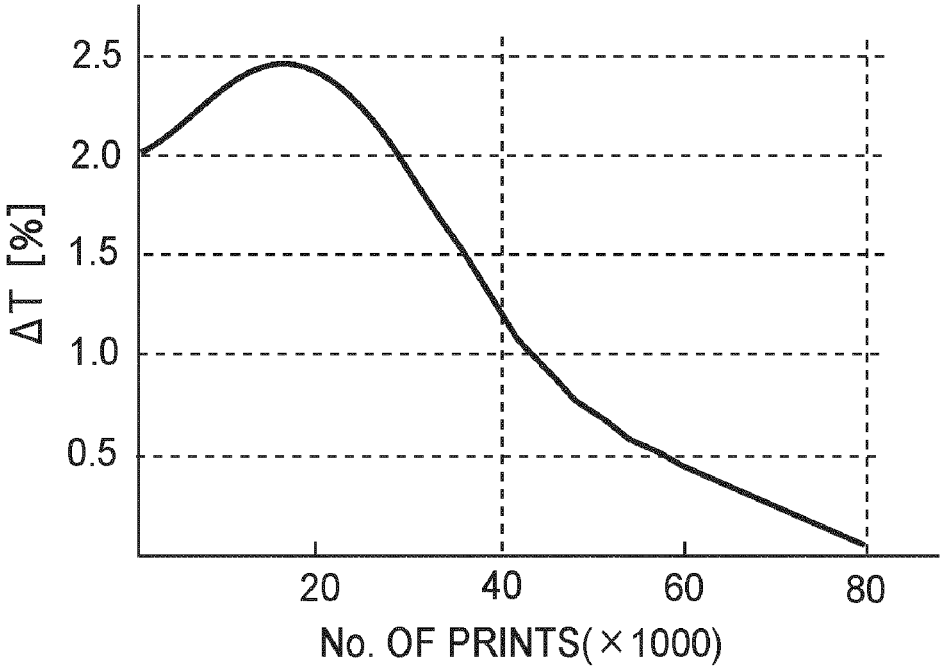
FIG. 7 is a graph showing the changes in the relationship between the number of copies (images) formed, and the target value for the toner density (TD) ratio.

In the case of the present invention, therefore, the following measure is taken to achieve the above-described object. That is, the number of days which has elapsed since the production of the toner in a toner cartridge is read. Then, the coefficient k of elapsed time is obtained by comparing the number of elapsed days with the reference value for the number of elapsed days. Then, the target value for the TD ratio is set according to the obtained coefficient k of elapsed time. Carrying out the above-described procedure can keep the amount of toner charge at a proper level; it can achieve the object of the present invention. The details of the procedure are as follows:

In this embodiment, in order to control the TD ratio in response to the change in the amount of charge obtainable by toner, which occurs with the elapse of time, the relationship between the coefficient k of elapsed days and the number of the days having elapsed since the production of the toner was set as shown in FIG. 6, and the relationship between the amount of recording paper used (number of copies made), and the amount ΔT of change in the target value for the TD ratio, was set as shown in FIG. 7. With the continuation of an image forming operation, the amount of the charge, which is obtainable by the toner in a developing device, changes in response to the increase in the number of copies made. Therefore, what is necessary to keep roughly constant (stable) the amount by which the toner in a developing device is charged, during an image forming operation in which a substantial number of copies are continuously made, is to change the target value for the density level, which is used for controlling the process of supplying the developing device with replenishment toner. FIG. 7 is a graph showing the amount ΔT by which the target value for density level is to be adjusted in order to keep roughly constant the amount of charge which the toner in the developing device 1 obtains, during an image forming operation in which a substantial number of images are continuously made.

The value of the coefficient k of elapsed time is changed between 0 and 1, where "t" stands for the number of days having elapsed since the production of the toner in the developing device. In this embodiment, k is set as follows:

$$k=0(0\leqq t<500)$$

$$k=0.0004\times(t-500)(500\leqq t<3000)$$

$$k=1(t\geqq 3000).$$

The target value Ttgt for the TD ratio, which is actually used for controlling the TD ratio with the use of the above-described k and ΔT, can be expressed as follows:

$$Ttgt=Tref-k\times\Delta T \quad (1)$$

Figure 8:
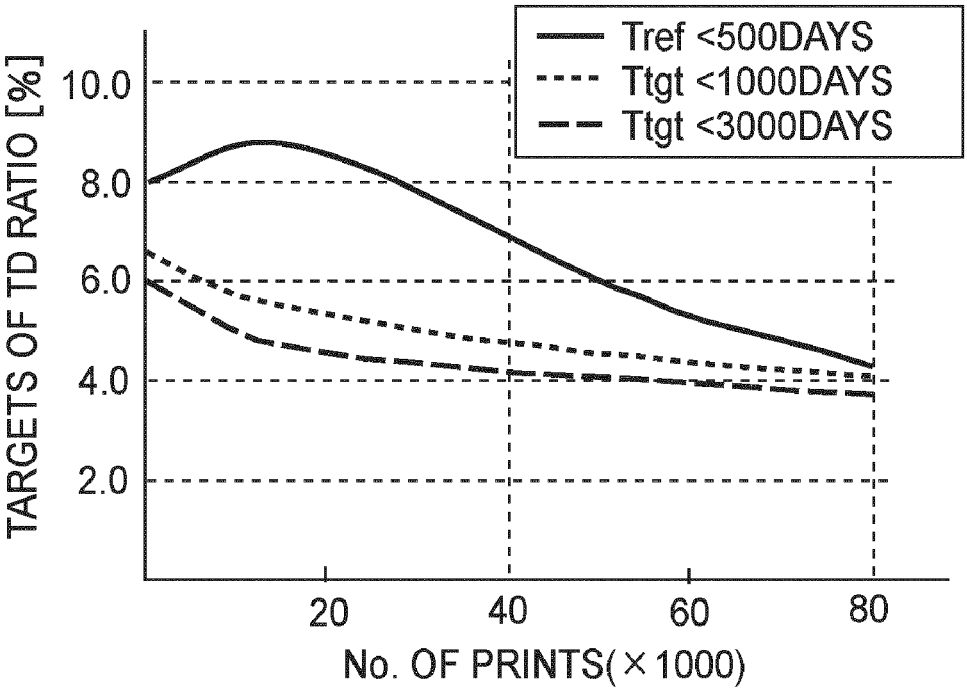
FIG. 8 is a graph showing the changes in the relationship among the number of the days which has elapsed since the production the developer, number of recording medium (copies) made, and target value for the TD ratio.

Tref is the target value for the TD ratio, which corresponds to the number of copies made with the use of the toner, which is no older than a reference amount of elapsed time, for example, 500 days (being therefore deemed to have not deteriorated at all, being therefore virtually brand-new), and is shown in FIG. 8. The relationship between the target value for the TD ratio and the amount of recording medium used (number of copies made), shown in the form of a graph in FIG. 8, was obtained based on the actual amount of charge, which the toner obtained when the developing device was actually operated.

Also shown in FIG. 8 is the change in the target value for the TD ratio, which was calculated, with the use of Equation (1), for 1,500 day old toner, and 3,000 day old toner. As will be evident from FIG. 8, when an image forming operation in which a large number of images are continuously formed is carried out with the use of the 1,500 day old toner or 3,000 day old toner, the amount of charge which the toner in the developing device obtains is kept roughly constant (stable), by substantially lowering the target value for the TD ratio, compared to the target value for the TD ratio to be used for the 500 day old toner (Tref), at the beginning of their usage, and keeping it lower through out an image forming operation.

Figure 9:
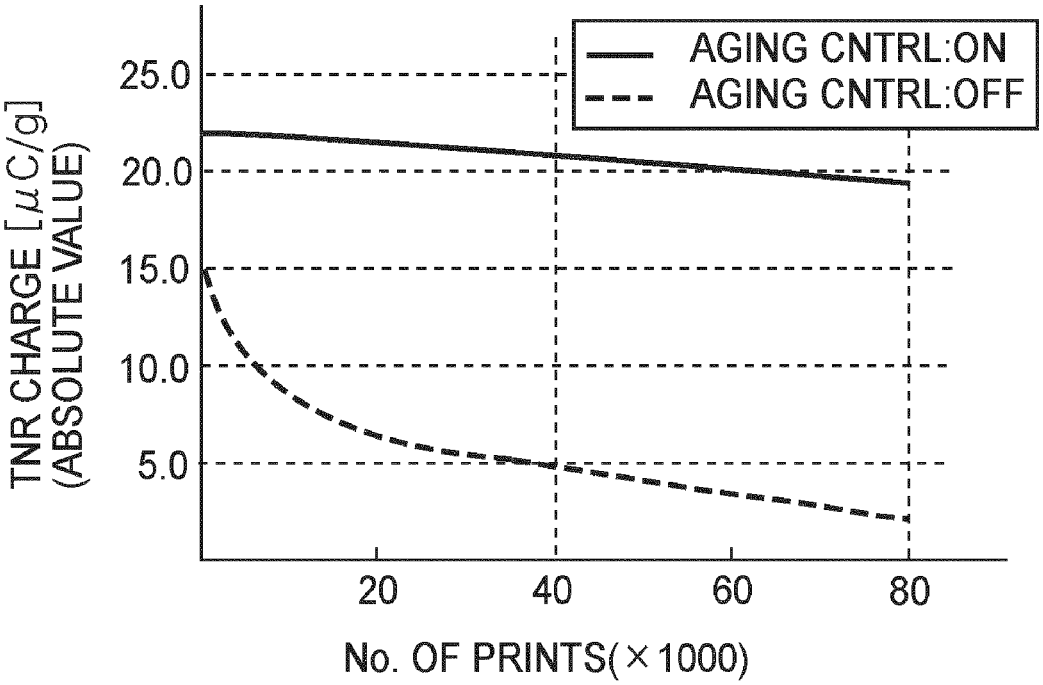
FIG. 9 is a graph showing the change in the amount of charge which toner obtained when the control in accordance with the present invention was executed, and the change in the amount of charge which toner obtained when the control in accordance with the present invention was not executed.

FIG. 9 shows the change in the amount of charge which the toner obtained when the 3,000 day old toner was used while executing the control in accordance with the present invention was executed, and the change in the amount of charge which the toner obtained when the 3,000 day old toner was used without executing the control in accordance with the present invention.

In the case of the control in this embodiment, the TD ratio was reduced in response to the reduction in the chargeability of toner, which occurs as toner is left unattended for a long time. Therefore, the amount by which the toner is charged remained relatively large in terms of absolute value, from the first copy to 80,000 copies, and also, the amount, by which the toner is charged, reduces due to usage, is small. Therefore, the image forming apparatus in this embodiment is unlikely to form a foggy image, and is smaller in the amount by which it scatters toner.

On the other hand, in a case where the above-described control was not executed, that is, in a case where the TD ratio is not reduced even though the toner reduced in chargeability because it was left unattended for a long time, the amount by which toner is charged is small in absolute value from the very beginning of an image forming operation, and the amount, by which the amount by which toner is chargeable reduces, is large. Therefore, in a case where the above-described control is not executed, the image forming apparatus is likely to form a foggy image, and also, is large in the amount by which it scatters toner. Therefore, it is difficult for the image forming apparatus to continuously output satisfactory images.

This result is the same as the result which was obtained when an image forming apparatus was used with the 1,500 day old toner, as one of the examples of the toners, the age of which was in the range of 500-3,000 days, in which the coefficient k of the elapsed days was proportional to the elapsed days. Incidentally, the 1,500 day old toner is smaller in the reduction in the amount of the chargeability of toner than the 3,000 day old toner. Therefore, when an image forming apparatus is used with the 1,500 day old toner, the amount by which it is charged can be kept at roughly 20 [μC/g] throughout an image forming apparatus in which a large number of images are formed, even though the 1,500 day old toner is smaller in the value of the coefficient k of elapsed time than the 3,000 day old toner.

Whether the coefficient k of elapsed time was to be switched or not was determined by measuring the TD ratio, at a preset point in time, for example, 1,500th day, 3,000th day, etc., which was necessary to keep roughly stable the amount by which toner was charged. In this case, by controlling the TD ratio, the amount by which toner was charged was kept in a proper range. Therefore, the image forming apparatus remained stable (constant) in terms of image density. In the case of this embodiment, the development bias may be adjusted relative to the potential level of an exposed point of the peripheral surface of the photosensitive drum, in order to stabilize the image forming apparatus in image density.

Also in the case of this embodiment, the toner cartridge 11 is provided with the toner conveying screw 13 and tag 30. The toner in the toner cartridge 11 is supplied to the developing device 1 by the screw 13, the driving of which is controlled by the control portion 41.

Next, referring to FIG. 10, how the tag 30 is used will be described.

Figure 10:
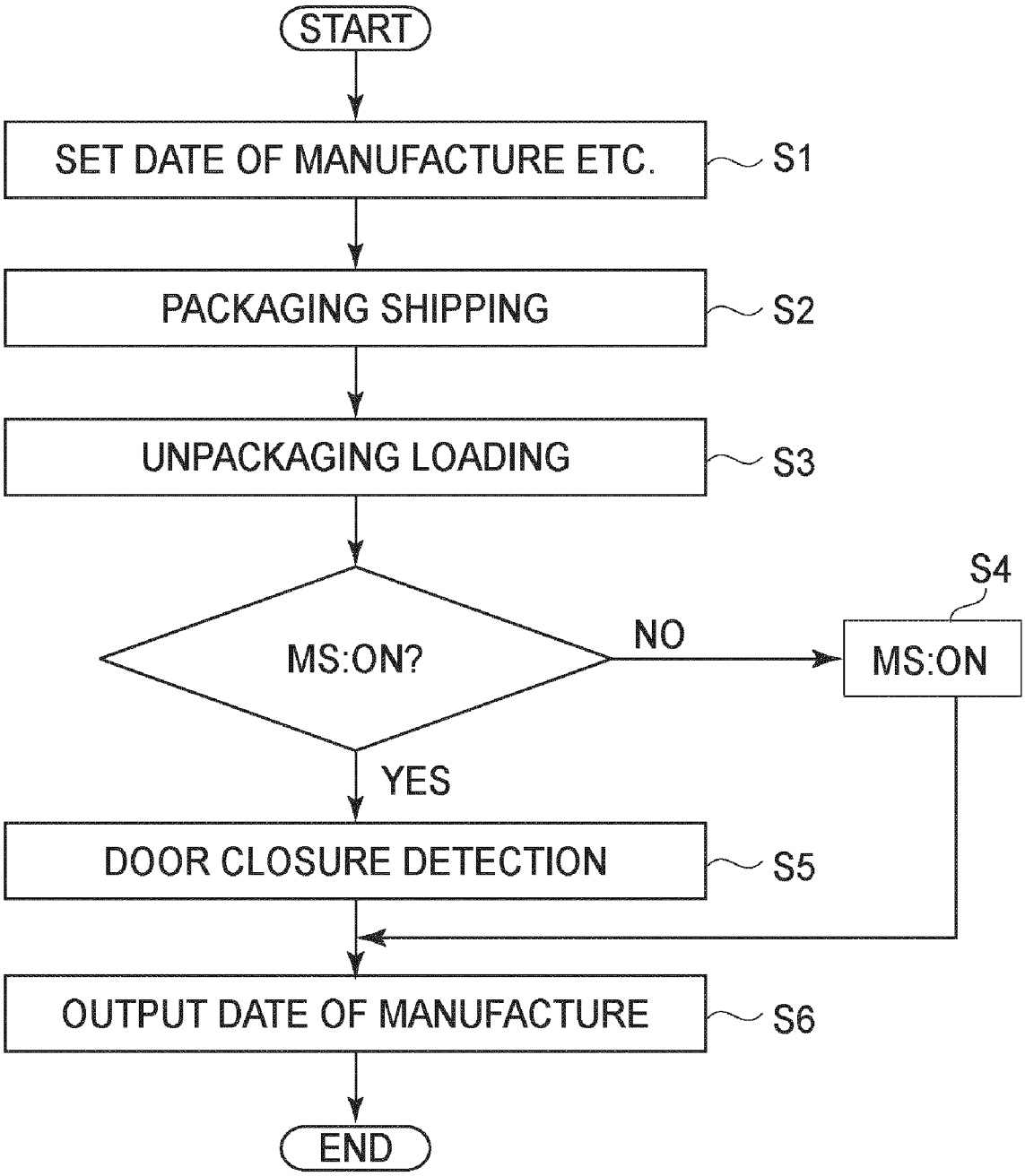
FIG. 10 is a flowchart of the operation for replenishing a developing device with developer with the use of a replenishment developer cartridge having a memory tag.

FIG. 10 is a flowchart showing how the tag 30 is used throughout the life of the toner cartridge 11.

First, right after the production of the toner cartridge 11, the information regarding the production date of the toner cartridge 11, initial number of rotations of the toner conveying screw 13, etc., is stored in the memory of the tag 30 (S1). Then, the toner cartridge 11 is sealed and wrapped, and then, is shipped out as merchandise (S2).

When a brand-new toner cartridge 11 is put to use for the first time, it is to be unwrapped and unsealed, and then, to be mounted in the image forming apparatus by a user or maintenance person of the image forming apparatus (S3).

When the main assembly 100A of the image forming apparatus 100 is on, the closing movement of the door, which always occurs when the cartridge 11 in the main assembly 100A is replaced, is detected (S5). Then, the production date of the cartridge 11 in the main assembly 100A is outputted from the memory of the tag 30 to the communicating portion 40 of the image forming apparatus 100 (S6).

When the main assembly 100A is off, the starting up of the main assembly 100A, which occurs as soon as the main assembly 100A is turned on, triggers the process of outputting the production date of the cartridge 11 in the main assembly 100A to the communicating portion 40 of the image forming apparatus (S6). Incidentally, as the main assembly 100A is turned on, the starting up of the image forming apparatus triggers the process of outputting the production date of the toner (toner cartridge 11) from the memory of the tag 30 to the communicating portion 40 of the image forming apparatus, regardless of whether or not the toner cartridge 11, which had been in the main assembly 100A, was replaced with a brand-new one immediately before the main assembly 100A was turned on.

Then, the number of days which elapsed after the production of the replenishment toner (toner cartridge) is calculated by the control portion 41 using the information regarding the production date of the replenishment toner, which was outputted to the communicating portion 40, and the information regarding the current date, which is stored in the time management portion 42.

At the same time, the information, such as the amount of the usage of the developing device 1, in terms of the number of copies made, which had been outputted from the tag 31 of the developing device 1 to the communicating portion 40 of the main assembly 100A of the image forming apparatus, and the value of the current TD ratio, which was outputted from the TD ratio detecting means 109, which the developing device 1 has, are sent to the control portion 41. Then, the developing device 1 is supplied with toner by an amount proportional to the difference between the afore-mentioned target value for the TD ratio (Ttgt), which was calculated by the control portion 41 based on the number of days which have elapsed since the production of the replenishment toner (toner cartridge 11) and the amount of usage of the developing device 1 (number of copies made), and the current TD ratio outputted from the TD ratio detecting means 109 of the developing device 1.

More specifically, toner is supplied to the developing device 1 by driving the toner delivery motor, for the amount of time necessary to rotate the toner conveying screw 13 in the toner cartridge 11 to deliver toner from the toner cartridge 11 to the developing device 1 by the amount, calculated by the control portion 41, by which toner needs to be delivered to the developing device 1.

As described above, according to this embodiment, the decision making means made up of the control portion 41 sets the target value for image density so that the target value to which image density is set in a case where the amount of time which has elapsed since the production of the toner (toner cartridge), is smaller than the reference value for the age of the replenishment toner, is smaller than the target value to which image density is set in a case where the amount of time which has elapsed since the production of toner (toner cartridge), is greater than the reference value for the age of the replenishment toner. In other words, in a case where a replenishment toner, which is substantial in the number of days which have elapsed since its production (production of toner cartridge), is used, the target value for the TD ratio is reduced as shown in FIG. 8. Therefore, even when a large number of copies are continuously formed, the developing device 1 can be kept constant at a level above a present standard in terms of the amount by which developer is charged, and therefore, it is possible to prevent the formation of foggy images, and/or the scattering of toner, which results in the formation of unsatisfactory images.

Embodiment 2

Next, the second embodiment of the present invention will be described.

The image forming apparatus in this embodiment is similar to that in the first embodiment, except that the range in which the TD ratio is varied has the maximum and minimum values. As far as the general structures of the image forming apparatus and developing apparatus are concerned, this embodiment is the same as the first one.

In this embodiment, in addition to the TD ratio detecting means 109 in the first embodiment, which is made up of the magnetic permeability sensor, a patch density sensor 110 is employed as the means for determining the amount by which the developing device 1 is to be supplied with the replenishment toner.

The patch density sensor 110 is used to assist the process of controlling the TD ratio based on the TD ratio detected by the magnetic permeability sensor 109, and also, to keep stable an image forming apparatus in terms of image density. In this embodiment, an image density sensor of the reflection type is employed as the patch density sensor 110.

It sometimes occurs that even though the development contrast voltage of the peripheral surface of the photosensitive drum 3 remains stable, an image forming apparatus changes in the image density because of the change in the amount of toner charge. Therefore, the magnetic permeability sensor 109 alone is insufficient for keeping an image forming apparatus stable in terms of image density by adjusting the TD ratio in accordance with the preset value for the TD ratio; it is impossible by adjusting the TD ratio in accordance with the preset target value for the TD ratio.

In this embodiment, therefore, as the cumulative number of sheets of recording medium having moved through the image forming apparatus exceeds a preset value, or right after the completion of the startup operation of the image forming apparatus, the patch density sensor 110 forms a patch on the transfer belt 21 (FIG. 1). If the detected image density of the patch is higher than the reference value, it means that the amount by which toner is charged was unsatisfactorily small because the TD ratio was excessively high. Thus, it is determined that the density is too high. Then, the table for compensating for the deviation in image density is read by the control portion 41, and the target value for the TD ratio for the magnetic permeability sensor 109 is set through by the control portion 41.

The control portion 41 controls the amount by which toner is supplied, by controlling the amount of time the toner is supplied to the developing device 1 from the toner cartridge 11, based on the difference between the TD ratio which was actually detected by the magnetic permeability sensor 109 and the target value for the TD ratio.

However, if the density of the patch is the only criterion used for setting the target value for the TD ratio, the following problem occurs. That is, in a case where the toner in the developing device 1 is small in the amount of deterioration attributable to elapsed time, and a developing device is short in terms of usage, that is, small in the number of copies made, the toner acquires a large amount of electrical charge, and therefore, it is unlikely for the density of the patch to be high. Thus, the TD ratio is likely to be excessively increased. Therefore, if the density of the patch is the only factor used for setting the target value for the TD ratio, it is likely for an image forming apparatus to form a foggy image, and/or toner scatters, when the image forming apparatus is used for the first time after being left unused for a substantial amount of time. On the other hand, if the amount of time of usage of the developing device 1 (number of copies made with use of developing device 1) is substantial, the TD ratio is likely to be set too low, making it likely for such a problem as the carrier adhesion to the photosensitive drum to occur.

Therefore, it is necessary to set the maximum and minimum values, for the TD ratio which is set according to the patch density detected by magnetic permeability sensor 109. In a case where the TD ratio set according to the patch density detected by the patch density sensor 110 is greater than the preset maximum value, or smaller than the preset minimum value, the maximum and minimum values set with the use of the magnetic permeability sensor 109 are used as the primary target values for controlling the TD ratio, to prevent the formation of the above-described unsatisfactory images.

Also in this embodiment, in a case where the maximum and minimum values set with the use of the magnetic permeability sensor are used over those obtained with the use of the patch density sensor, and in addition, the image density does not fall within the preset range, the development bias relative to the potential level of an exposed point of the peripheral surface of the photosensitive drum may be adjusted, as an additional means for rectifying the image forming apparatus in terms of image density.

Further, unless these maximum and minimum values for the TD ratio are adjusted according to the degree of toner deterioration attributable to the elapse of time, the formation of a foggy image, and/or the formation of unsatisfactory images, which is attributable to the scattering of toner, cannot be prevented, neither can the image forming apparatus be kept in a preset range in terms of image density.

In this embodiment, therefore, the following measure is taken. That is, first, the number of days which have elapsed since the production of the toner in a toner cartridge, is read. Then, the coefficient k of elapsed time is obtained based on the number of elapsed days. Then, the target value for the TD ratio is set according to the obtained coefficient k of elapsed time. With the use of this procedure, it is possible to keep an image forming apparatus stable in terms of the amount of toner charge, in order to achieve the object of the present invention. The details of this procedure are as follows:

The value of the coefficient k of elapsed time obtained from the number of days having elapsed since the production of the replenishment toner is the same as that in the first embodiment. That is, the coefficient k of elapsed time is changed within a range from 0 (k=1) to 1 (k=1) according to the number t of elapsed days. In this embodiment, the following values are used as the coefficient k of elapsed time:

$$k=0(0\leqq t<500)$$

$$k=0.0004\times(t-500)(500\leqq t<3000)$$

$$k=1(t\geqq 3000).$$

Figure 11:
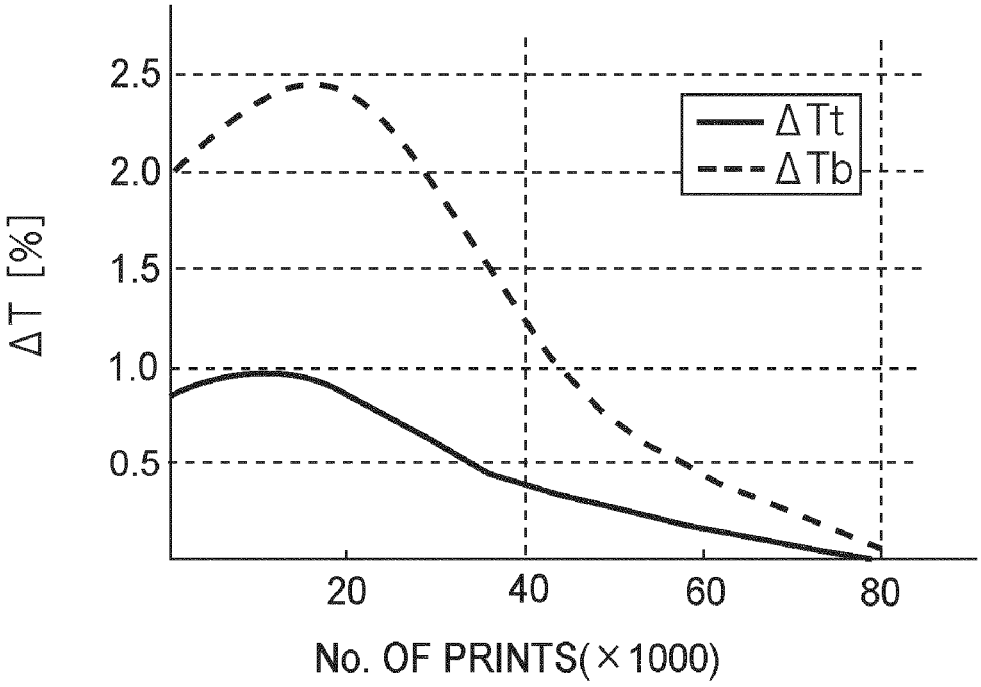
FIG. 11 is a graph showing the change in the relationship between the number of copies made, and the maximum and minimum target values ($\Delta Tt$ and $\Delta Tb$, respectively) for the TD ratio.

Shown in FIG. 11 are the relationship between the maximum value Tt for the TD ratio and the cumulative copy count, and the relationship between the minimum value Tb for the TD ratio and the cumulative copy count. The methods for calculating the maximum and minimum values T1 and T2 for the TD ratio are as follows:

$$T1=Tref1-k\times\Delta Tt \quad (2)$$

$$T2=Tref2-k\times\Delta Tb \quad (3)$$

Figure 12:
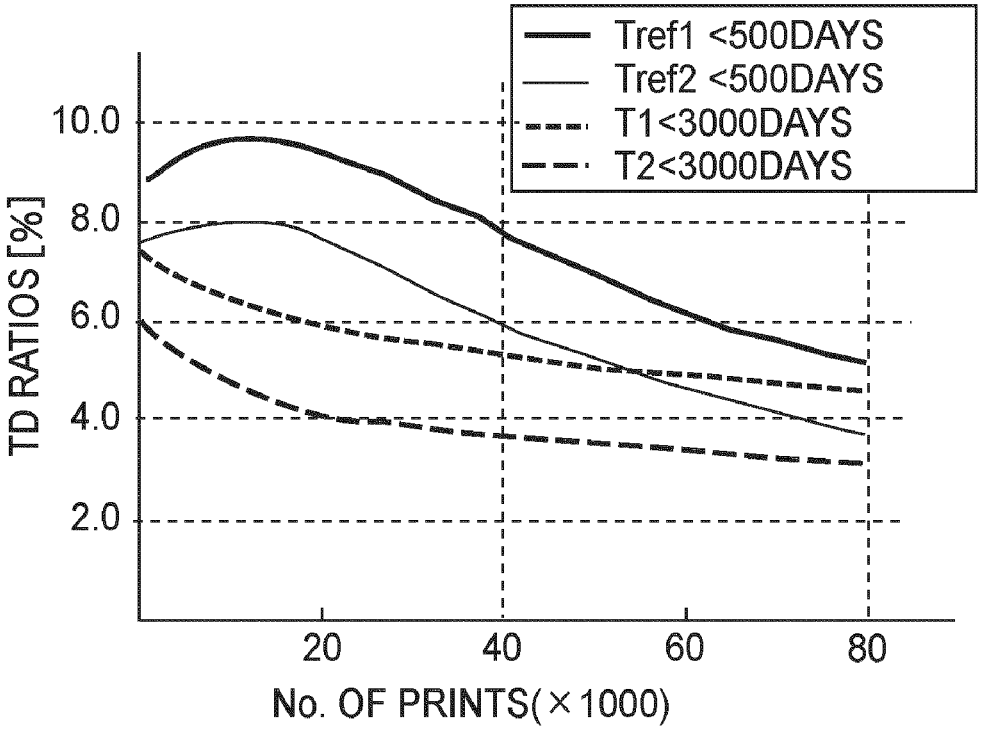
FIG. 12 is a graph showing the change in the relationship among the number of days having elapsed since the production of developer, number of copies made, and maximum and minimum target values ($\Delta Tt$ and $\Delta Tb$, respectively) for the TD ratio.

Here, Tref1 and Tref2 stand for the maximum and minimum values for the TD ratio when the toner is brand-new, which are shown in FIG. 12. "Brand-new toner" means toner which is no older than 500 days, as it did in the first embodiment.

Also shown in FIG. 12 are the changes in the relationship between the maximum value T1 for the TD ratio for the replenishment toner which is 3,000 days old (which was calculated using Equation (2)), and the cumulative copy count, and the changes in the relationship between the minimum value T1 for the TD ratio for the replenishment toner which is 3,000 day old (which was calculated using Equation (3)), and the cumulative copy count.

Figure 13:
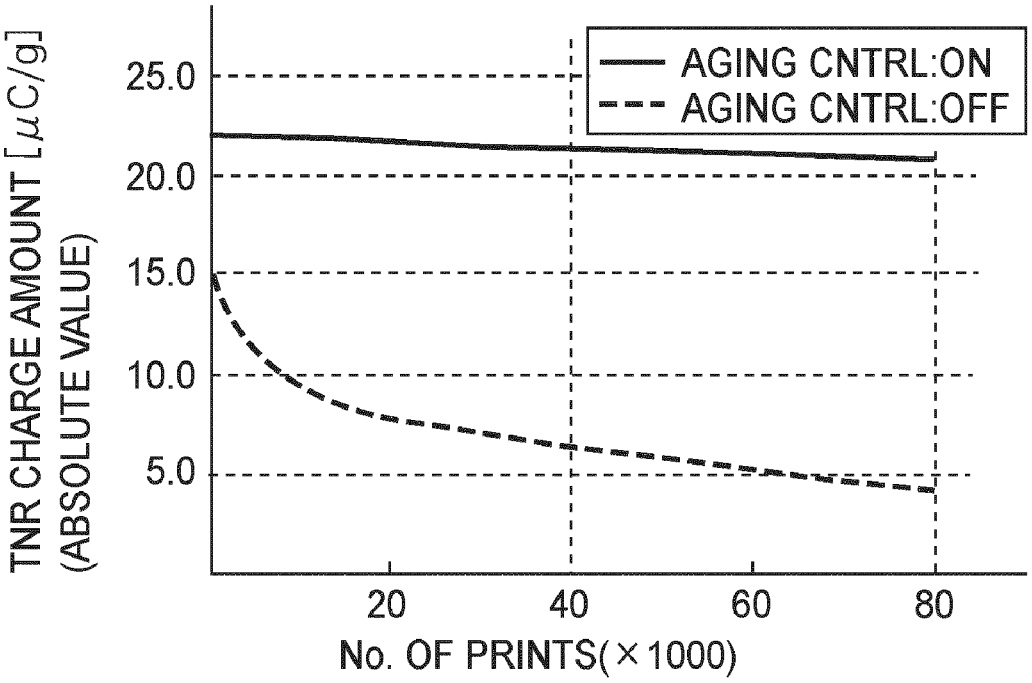
FIG. 13 is a graph showing the change in the amount of charge which toner obtained when the control in accordance with the present invention was executed, and the change in the amount of charge which toner obtained when the control in accordance with the present invention was not executed.

FIG. 13 is a graph showing the changes which occurred to the relationship between the amount of toner charge and cumulative copy count, when the 3,000 day old replenishment'toner was used to make 8,000 copies while carrying out the above-described control (control was turned on), and the changes which occurred to the relationship between the amount of toner charge and the cumulative copy count, when the 3,000 day old replenishment toner was used to make 8,000 copies without carrying out the above-described control (control was not turned on).

When the control was executed, the TD ratio was reduced in response to the reduction in the chargeability of the replenishment toner, which occurred because the toner was left unattended for a substantial amount of time. Therefore, the amount by which the replenishment toner acquired electrical charge remained relatively large from the first copy to the 8,000th copy, and also, the amount, by which the amount by which the toner was charged reduced, remained relatively small. Therefore, the image forming apparatus did not form a foggy image, and also, was small in the amount of scattered toner.

In comparison, when the control was not executed, the TD ratio was not reduced in spite of the reduction in the chargeability of toner, which occurred because the toner was left unattended for a substantial amount of time. Therefore, the amount by which toner acquired electrical charge remained small in absolute value, from the very beginning of the image forming operation, and further, the amount by which the toner was charged substantially reduced with the increase in the cumulative copy count. Therefore, the image forming sometimes formed a foggy image, and also, a relatively large amount of toner was scattered. Thus, it was proved that it is difficult to continuously output a substantial number of satisfactory copies without carrying out the above-described control.

This result, in particular, the result regarding the amount of toner charge, is the same as what occurred when 1,500 day old toner was used as an example of toners which are 500-3,000 days old, which are different in the coefficient k of elapsed time. However, the 1,500 day old toner is lower in chargeability than the 3,000 day old toner. Therefore, when an image forming apparatus is used with the 1,500 day old toner, the amount by which it is charged can be kept at roughly 20 [μC/g] throughout an image forming apparatus in which a large number of images are continuously formed, even though the 1,500 day old toner is smaller in the value of the coefficient k of elapsed time than the 3,000 day old toner.

As described above, according to this embodiment, the decision making means made up of the control portion 41 calculates the amount of time which has elapsed since the production date of a replenishment developer, based on the information regarding the elapsed time. Then, it sets the maximum and minimum target values for image density, according to the calculated amount of the elapsed time. Further, the decision making means sets the maximum and minimum target values so that the maximum and minimum target values to which image density is set in a case where the amount of time which has elapsed since the production of the toner (toner cartridge), is smaller than the reference value for the elapsed time, are smaller and greater than the maximum and minimum target values to which image density is set in a case where the length of time which has elapsed since the production of the toner (toner cartridge), is greater than the reference value for the elapsed time. In other words, the maximum and minimum values for the TD ratio are reduced according to the coefficient k of elapsed time, as shown in FIG. 12. Therefore, even when a replenishment toner, which is substantial in the number of days which has elapsed since its production (production of toner cartridge), is used for continuously making a substantial number of copies, the amount by which developer is charged can be kept above a preset level. Therefore, it is possible to prevent the formation of unsatisfactory images, such as a foggy image.

As described above, according to the present invention, an image forming apparatus is adjusted in the TD ratio according to the age of the toner with which the apparatus is supplied. Therefore, even if it is supplied with toner which is substantial in the number of days having elapsed since its production, it does not form a foggy image, and/or an image suffering from the defects attributable to the scattering of toner; it can continuously form satisfactory images.

Embodiment 3

Figure 14:
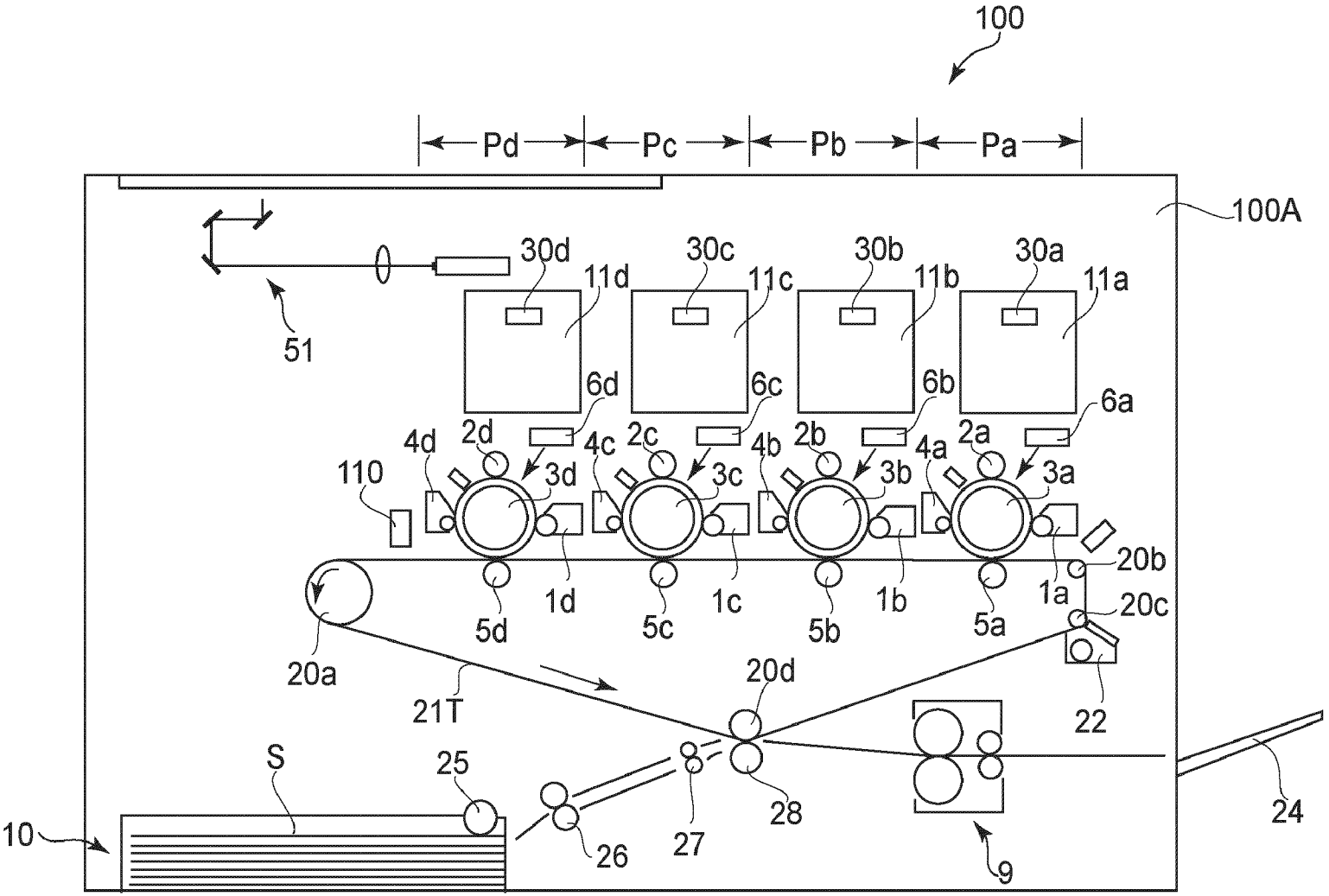
FIG. 14 is a schematic, sectional view of the image forming apparatus in another according to a second embodiment of the present invention, showing the general structure of the apparatus.

FIG. 14 is a schematic, sectional view of the color image forming apparatus according to a third embodiment of the invention, and shows the general structure of the apparatus. This image forming apparatus is of the so-called tandem type. It is also of the intermediary transfer type.

The image forming apparatus 100 in this embodiment is similar in structure as the color image forming apparatus of the direct transfer type in the first embodiment, except for the following feature. That is, the image forming apparatus 100 in the first embodiment is structured so that the toner images formed on the peripheral surfaces of the photosensitive drums 3 in the image forming apparatuses P (Pa, Pb, Pc, and Pd) are directly transferred onto the transfer medium S while the transfer medium S is conveyed by the transfer belt 21 through the image forming portions P (Pa, Pb, Pc, and Pd). The image forming apparatus 100 in this embodiment is different from that in the first embodiment only in that it employs an intermediary transfer belt 21T, which is an intermediary transferring member in the form of a belt, instead of the transfer belt 21.

Thus, the components of the image forming apparatus in this embodiment, which are the same in structure and function as those of the image forming apparatus in the first embodiment are given the same reference numerals and characters as those given to the corresponding components of the image forming apparatus in the first embodiment, in order to utilize the description of the image forming apparatus in the first embodiment, as the description for the image forming apparatus in this embodiment. Thus, the image forming apparatus in this embodiment will not be described.

As described above, this embodiment is different from the first embodiment, in that the toner images formed on the peripheral surfaces of the photosensitive drums 3 are sequentially transferred onto the intermediary transfer belt 21T to effect a full-color image on the intermediary transfer belt 21T. Then, the full-color image on the intermediary transfer belt 21T is transferred, by applying voltage to a transfer roller 28 as a secondary transferring means, onto the transfer medium S, which is being conveyed through the transfer portion after being fed from a recording medium cassette 10 while being separated from the rest of recording mediums in the cassette 10.

Then, the transfer medium S is conveyed to the fixing portion 9, in which heat and pressure are applied to the transfer medium S and the transferred full-color toner image thereon to fix the full-color image to the transfer medium S. Thereafter, the transfer medium S is discharged into a delivery tray 24.

The color image forming apparatus in this embodiment, that is, a color image forming apparatus of the intermediary transfer type, is also controlled in TD ratio in the same manner as the color image forming apparatuses in the first and second embodiments. Therefore, it is capable of achieving the same effects as those achievable by the image forming apparatuses in the first and second embodiments.

In other words, the image forming apparatus in this embodiment is also adjusted in the TD ratio according to the age of the toner with which the apparatus is supplied. Therefore, even if it is supplied with toner which is substantial in the number of days having elapsed since its production, it does not form a foggy image, and/or an image suffering from the defects attributable to the scattering of toner; it can continuously form satisfactory images.

Further, also in this embodiment, the maximum and minimum target values for the TD ratio are reduced based on the coefficient k of elapsed time, as shown in FIG. 12. Therefore, even when a replenishment toner, which is substantial in the number of days which have elapsed since its production (production of toner cartridge), is used, and/or even when a substantial number of copies are continuously made, the amount by which developer is charged remains above a preset value (level). Therefore, it is possible to prevent the formation of unsatisfactory images, such as a foggy image.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 022309/2007 filed Jan. 31, 2007, which is hereby incorporated by reference.

What is claimed is:

1. An image forming apparatus comprising:

an image bearing member on which an electrostatic image is to be formed;

a developing device for accommodating a developer including toner and a carrier and for developing the electrostatic image with the developer;

a developer supply container, detachably mountable to a main assembly of the image forming apparatus, for accommodating a supply developer including the toner;

a detecting device for detecting a toner content of the developer in said developing device;

a supply control device for controlling an operation of supplying the supply developer into said developing device on the basis of a detection result of said detecting device and a density target value;

a memory element, provided on said developer supply container, for storing information relating to an elapse of time from a manufacturing date of the supply developer; and a controller for determining the density target value such that a density target value determined when the elapse of time is longer than a reference elapse of time is smaller than the density target value determined when the elapse of time is shorter than the reference elapse of time.

2. An apparatus according to claim 1, wherein said controller changes the density target value in accordance with a number of image formations.

3. An apparatus according to claim 1, wherein said memory element stores information relating to the manufacturing date of said developer supply container as the information relating to the elapse of time.

4. An image forming apparatus comprising:

an image bearing member on which an electrostatic image is to be formed;

a developing device for accommodating a developer including toner and a carrier and for developing the electrostatic image with the developer;

a developer supply container, detachably mountable to a main assembly of the image forming apparatus, for accommodating a supply developer including the toner;

a toner content detecting device for detecting a toner content of the developer in said developing device;

an image density detecting device for detecting a density of a formed reference toner image;

a controller for determining a density target value on the basis of the detection result of said image density detecting device, within a predetermined range between upper and lower limit values;

a supply control device for controlling an operation of supplying the supply developer into said developing device on the basis of the detection result of said toner content detecting device and the density target value; and a memory element, provided on said developer supply container, for storing information relating to an elapse of time from a manufacturing date of the supply developer, wherein said controller determines the upper and lower limit values such that upper and lower limit values determined when the elapse of time is longer than a reference elapse of time are smaller than upper and lower limit values determined when the elapse of time is shorter than the reference elapse of time.

5. An apparatus according to claim 4, wherein said controller changes the upper and lower limit values in accordance with a number of image formations.

6. An apparatus according to claim 4, wherein said memory element stores information relating to a manufacturing date of said developer supply container as the information relating to the elapse of time.

* * * * *